US011891233B2

(12) United States Patent
Marchitto et al.

(10) Patent No.: US 11,891,233 B2
(45) **Date of Patent: *Feb. 6, 2024**

(54) RIGID PACK OF SMOKING ARTICLES WITH A HINGED AND SLIDING LID

(71) Applicant: G.D SOCIETA' PER AZIONI, Bologna (IT)

(72) Inventors: Giuseppe Marchitto, Bologna (IT); Roberto Polloni, Bologna (IT); Giuliano Gamberini, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 0 days.

This patent is subject to a terminal disclaimer.

(21) Appl. No.: 17/796,569

(22) PCT Filed: Jan. 29, 2021

(86) PCT No.: PCT/IB2021/050720

§ 371 (c)(1),
(2) Date: Jul. 29, 2022

(87) PCT Pub. No.: WO2021/152529

PCT Pub. Date: Aug. 5, 2021

(65) Prior Publication Data

US 2023/0051682 A1 Feb. 16, 2023

(30) Foreign Application Priority Data

Jan. 31, 2020 (IT) ..... 102020000001873

(51) Int. Cl.
*B65D 85/10* (2006.01)
*B65D 5/66* (2006.01)

(52) U.S. Cl.
CPC ..... *B65D 85/10564* (2020.05); *B65D 5/6691* (2013.01)

(58) Field of Classification Search
CPC ..... B65D 85/10564; B65D 85/1056; B65D 5/6691; B65D 5/6688; B65D 5/6673; B65D 5/6632
(Continued)

(56) References Cited

U.S. PATENT DOCUMENTS 2,358,802 A * 9/1944 Glover ..... B65D 5/68 206/268
3,311,283 A * 3/1967 Shimada ..... B65D 5/6688 206/250

(Continued)

FOREIGN PATENT DOCUMENTS

CN 201458028 U 5/2010
DE 102007009251 A1 8/2008

(Continued)

OTHER PUBLICATIONS

International Search Report and Written Opinion for Corresponding International Application No. PCT/IB2021/050720, dated May 26, 2021.

*Primary Examiner* — Rafael A Ortiz
(74) *Attorney, Agent, or Firm* — MARSHALL, GERSTEIN & BORUN LLP

(57) ABSTRACT

A pack of smoking articles having: a container; an inner wrap enclosing a group of smoking articles housed in the container; a hinged lid movable between open and closed positions; a collar glued on the inside of the container so as to partially project out of an open top end and engage a corresponding inner surface of the lid when the lid is in a closed position; a slider firmly connected to the lid and coupled in a sliding manner to the container so as to slide relative to the container; and a locking system interposed between the container and the slider and, in the closed position of the lid, prevents the slider from sliding relative to the container. The hindering of the slider can be deacti- (Continued)

vated by external action of the user who elastically deforms at least part of the front wall of the container.

11 Claims, 8 Drawing Sheets

(58) Field of Classification Search
USPC ..... 206/270, 265, 267, 268
See application file for complete search history.

(56) References Cited

U.S. PATENT DOCUMENTS 3,400,874 A * 9/1968 Shimada ..... B65D 5/6688 206/250
3,933,299 A * 1/1976 Shimada ..... B65D 5/6688 D27/189
8,757,371 B2 * 6/2014 Draghetti ..... B65D 85/10564 206/268
10,017,291 B2 * 7/2018 Smith ..... B65D 5/728
2002/0189969 A1 * 12/2002 Renck ..... B65D 81/054 206/453
2008/0047226 A1 * 2/2008 Corsini ..... B65B 19/20 53/234
2013/0248392 A1 * 9/2013 Roila ..... B65D 5/6685 206/268
2016/0100630 A1 * 4/2016 Clark ..... B65D 85/1054 206/268

FOREIGN PATENT DOCUMENTS

EP 1466844 A1 10/2004
EP 1884467 A1 2/2008
EP 3418213 A1 * 12/2018
GB 2530090 A 3/2016
WO WO-2010/058237 A1 5/2010
WO WO-2013/131616 A1 9/2013
WO WO-2013131616 A1 * 9/2013 ..... B65D 85/1009

* cited by examiner

RIGID PACK OF SMOKING ARTICLES WITH A HINGED AND SLIDING LID

CROSS-REFERENCE TO RELATED APPLICATIONS

This patent application is a U.S. national phase of International Patent Application No. PCT/IB2021/050720 filed Jan. 29, 2021, which claims the benefit of priority from Italian patent application no. 102020000001873 filed on Jan. 31, 2020, the respective disclosures of which are each incorporated herein by reference in their entireties.

TECHNICAL FIELD

The present invention relates to a rigid pack of smoking articles provided with a hinged and sliding lid.

The present invention finds advantageous application to a pack of cigarettes, to which the following description will make explicit reference without thereby losing generality.

PRIOR ART

The rigid packs of cigarettes with hinged lids are currently the most widespread packs of cigarettes on the market as they are simple to manufacture, are easy and practical to use, and offer effective protection to the cigarettes contained within.

A rigid pack of cigarettes with a hinged lid comprises a group of cigarettes wrapped in a wrapping sheet of metallized paper to define an inner wrap and a rigid container that houses the inner wrap; the container is cup-shaped, has an open top end, and is provided with a lid, which is also cup-shaped and is hinged to the container along a hinge so as to rotate, relative to the container, between an open position and a closed position of the open end. A collar is normally provided, which is folded and connected to the inside of the container so as to partially project out of the open end and engage a corresponding inner surface of the lid when the lid is arranged in the closed position.

A new type of rigid pack of cigarettes has recently been proposed, described for example in the patent application EP1466844A1 and wherein the lid performs a roto-translation (i.e., both a translation and a rotation) to pass from the closed position to the open position and vice versa. The opening of this rigid pack of cigarettes is simple and intuitive even for a child and therefore said rigid pack of cigarettes cannot be classified as "child-proof" or "child resistant", namely, able to prevent children from opening the same. Normally, a pack of cigarettes is classified as "child-proof" if its opening, i.e., the possibility of accessing the content, is precluded by mechanisms that an uninformed user would not be able to unlock. In other words, a pack of cigarettes is defined as "child-proof" when its opening (and therefore access to the content) is not immediate and requires the application of particular force or torque in predetermined points, or sequences of non-intuitive movements for the effective unlocking of the opening of the pack of cigarettes.

The patent application DE102007009251A1 describes a rigid pack of cigarettes comprising: a container, a hinged lid that performs a roto-translation (i.e., both a translation and a rotation) to pass from the closed position to the open position and vice versa, a collar glued on the inside of the container, and a slider which is firmly connected to the lid and is slidingly coupled to the container.

DESCRIPTION OF THE INVENTION

The purpose of the present invention is to provide a rigid pack of smoking articles provided with a hinged and sliding lid that can be classified as "child-proof", namely, able to prevent children from opening the same, and at the same time, easy and inexpensive to implement.

According to the present invention, a rigid pack of smoking articles provided with a hinged and sliding lid, according to what is claimed in the attached claims is provided.

The claims describe preferred embodiments of the present invention forming an integral part of the present description.

BRIEF DESCRIPTION OF THE DRAWINGS

The present invention will now be described with reference to the attached drawings, which illustrate some non-limiting embodiments thereof, wherein.

PREFERRED EMBODIMENTS OF THE INVENTION

Figure 2:
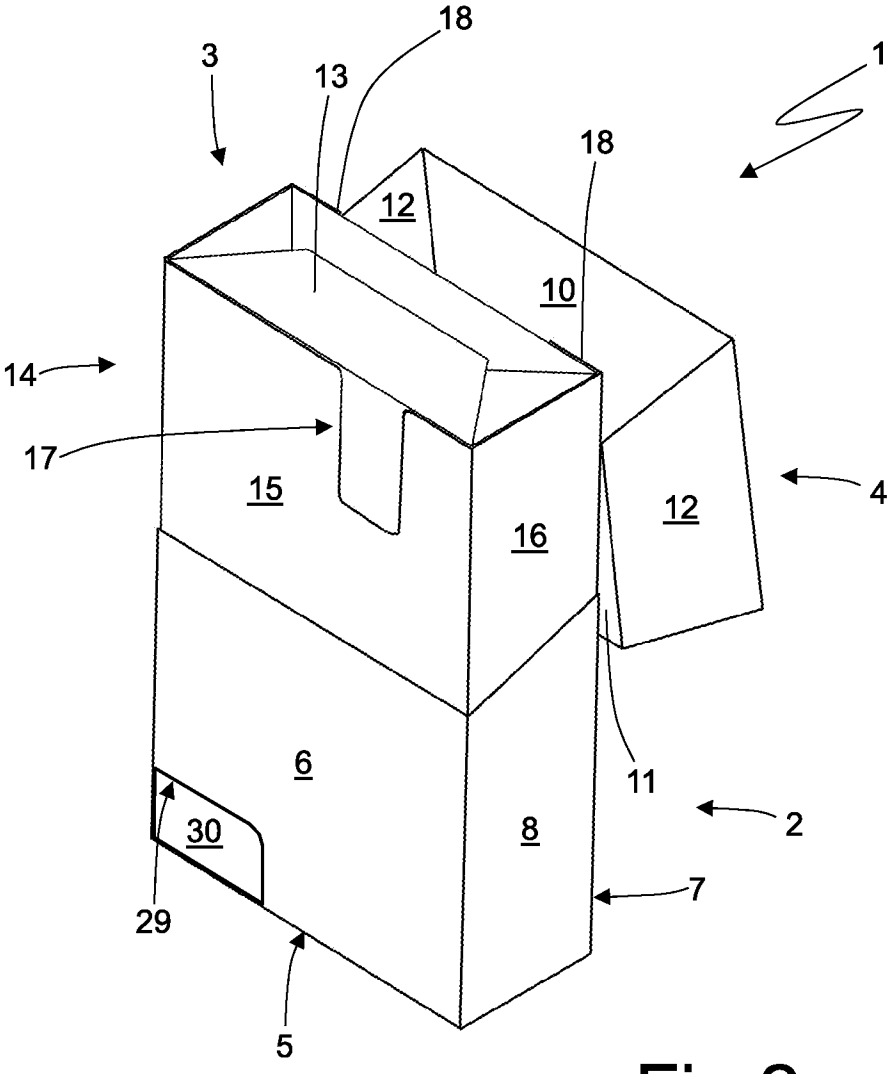
FIG. 2 is a front perspective view of the pack of cigarettes of FIG. 1 in an open configuration.
Figure 1:
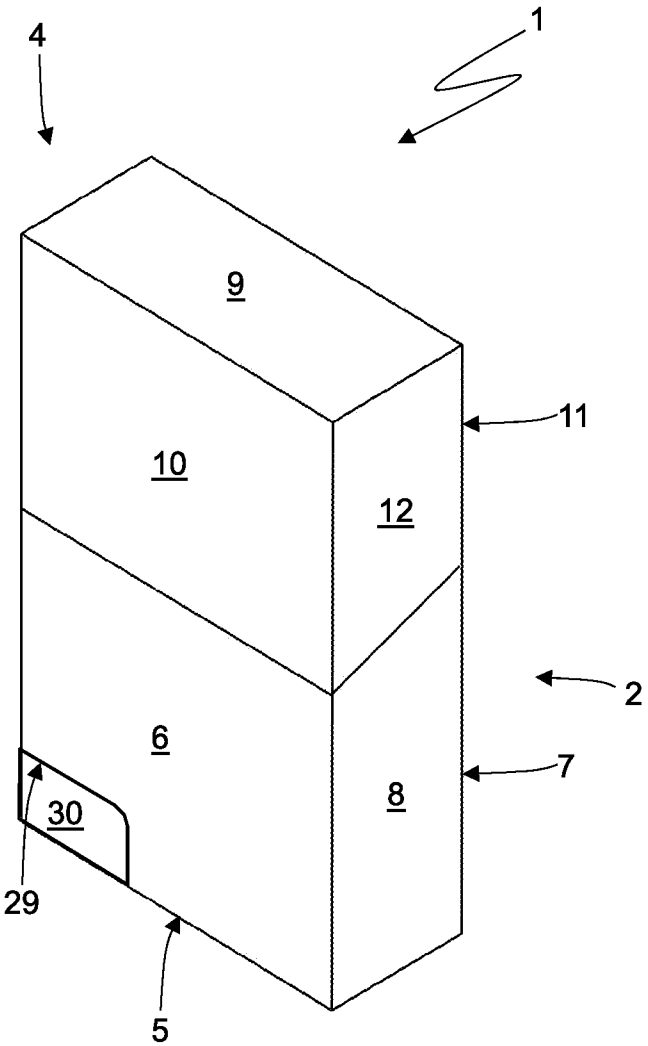
FIG. 1 is a front perspective view and in a closed configuration of a pack of cigarettes made according to the present invention.
Figures 3, 4, 5:
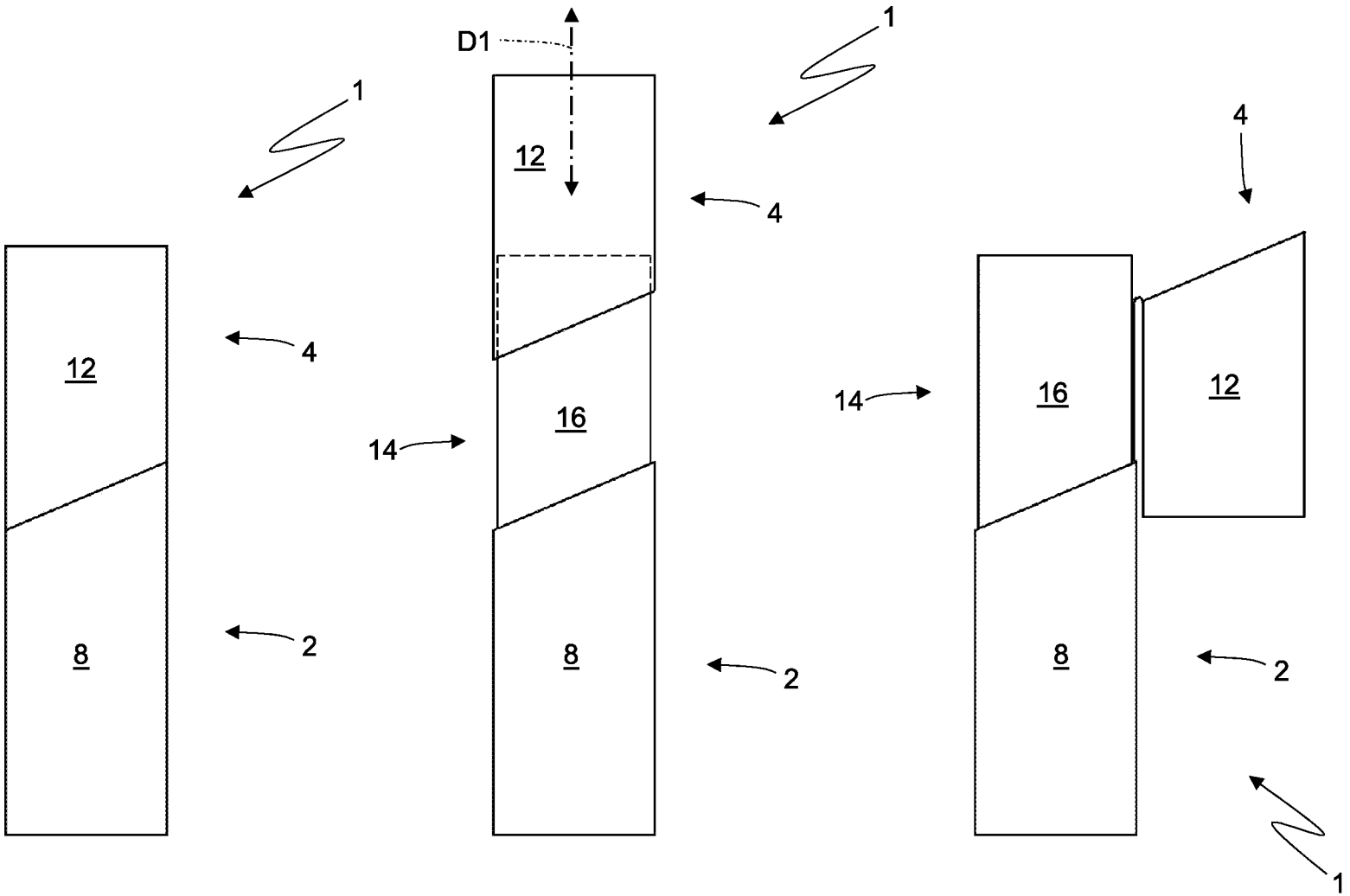
FIGS. 3, 4 and 5 are three side views of the pack of cigarettes of FIG. 1 during the opening of the lid.

In FIGS. 1, 2 and 3, the number 1 denotes, as a whole, a rigid pack of cigarettes.

The pack 1 of cigarettes comprises a container 2 made of cardboard or rigid paperboard and is cup-shaped. The container 2 has an open top end 3 (illustrated in FIG. 2) and is provided with a lid 4, which is cup-shaped and is connected to the container 2 to move by means of a roto-translation movement relative to the container 2 between a closed position (illustrated in FIG. 1) in which the top end 3 is covered and therefore inaccessible from the outside and an open position (illustrated in FIG. 2) in which the open top end 3 is free and therefore accessible from the outside.

The container 2 has a substantially rectangular parallelepiped shape oriented according to a prevalently vertical development direction, is cup-shaped, and has an open top end 3, a bottom wall 5 opposite the open top end 3, a front wall 6 and a rear wall 7 which are parallel to and opposite one another, and two side walls 8, which are parallel to and opposite one another. Four longitudinal edges are defined between the front 6, rear 7 and side 8 walls of the container 2, while four transverse edges are defined between the walls 6, 7 and 8 and the bottom wall 5 of the container 2.

The lid 4 has a substantially rectangular parallelepiped shape, is cup-shaped, and has an open bottom end (facing the open top end 3 of the container 2 when the lid 4 is in the closed position), a top wall 9 (which is parallel to and opposite the bottom wall 5 of the container 2 when the lid 4 is in the closed position), a front wall 10 (which is parallel to and aligned with the front wall 6 of the container 2 when the lid 4 is in the closed position), a rear wall 11 (which is parallel to and aligned with the rear wall 7 of the container 2 when the lid 4 is in the closed position), and two side walls 12 which are parallel to and opposite one another (which are parallel to and aligned with, in particular coplanar and adjacent to, the side walls 8 of the container 2 when the lid 4 is in the closed position). Four longitudinal edges are defined between the front 10, rear 11 and side 12 walls of the lid 4, while four transverse edges are defined between the walls 10, 11 and 12 and the top wall 9 of the lid 4. The longitudinal edges and the transverse edges of the lid 4 are parallel to and aligned with the corresponding longitudinal and transverse edges of the container 2 when the lid 4 is in the closed position.

As illustrated in FIG. 2, the pack 1 of cigarettes comprises an inner wrap 13 which is housed inside the container 2 and encloses a parallelepiped-shaped group of cigarettes (not illustrated). According to the embodiment illustrated in FIG. 2, the inner wrap 13 is not sealed, is formed by a sheet of metallized paper (the so-called "tinfoil") folded around the group of cigarettes and without glue, and has a top portion removable by tearing (called "pull") which is removed upon the first opening of the pack 1 of cigarettes; according to a different embodiment not illustrated, the inner wrap 13 is sealed and has a cigarette extraction opening at the top and in front closed by a repositionable closing label (i.e. of the "open and close" type).

Figure 6:
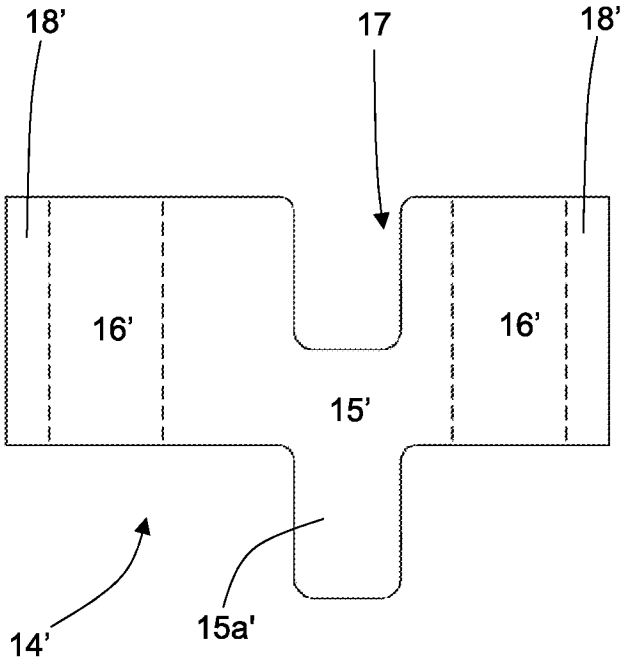
FIG. 6 is a plan view of a flat blank used to form a collar of the pack of cigarettes of FIG. 1.
Figure 11:
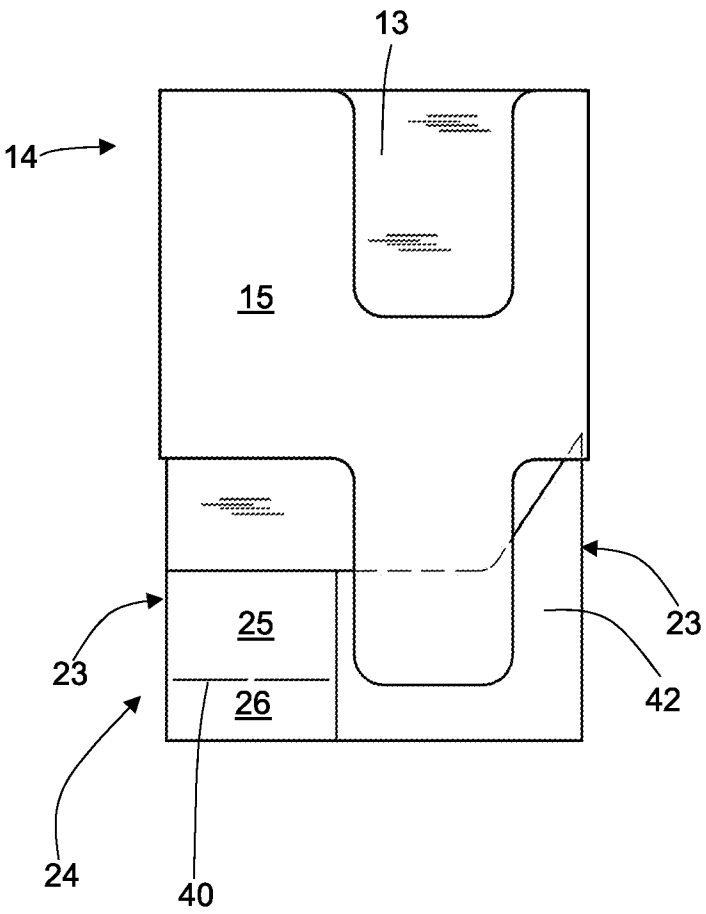
FIG. 11 is a front view of the pack of FIG. 1 in which the container provided with a lid has been removed in order to better highlight other parts of the pack.
Figure 10:
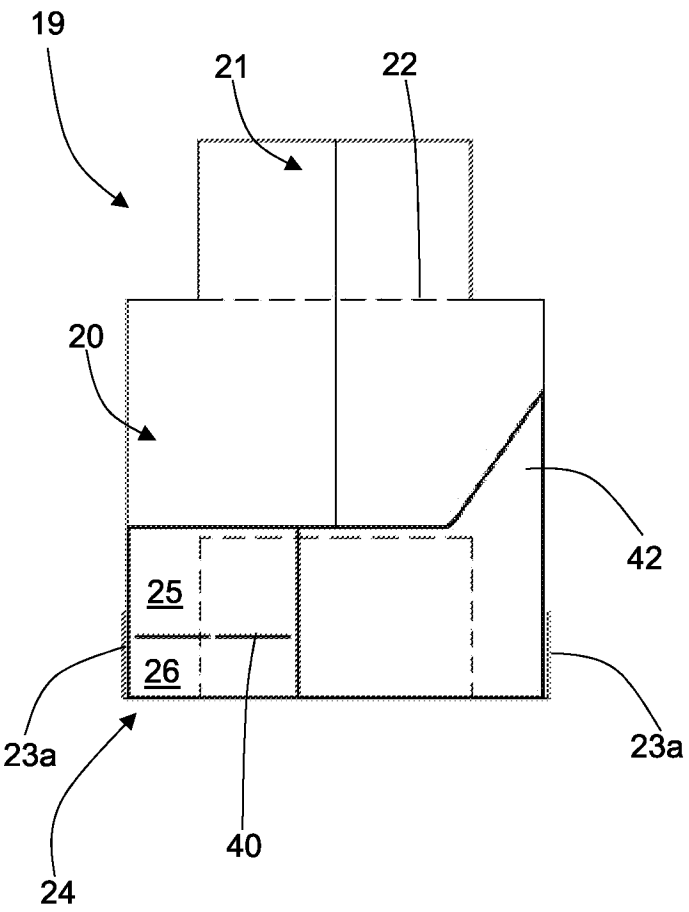
FIG. 10 is a front view of the slider obtained by folding the blank of FIG. 7.

As illustrated in FIGS. 2, 6 and 11, the pack 1 comprises, furthermore, a collar 14, which is connected by gluing inside the container 2 so as to partially project out of the open top end 3 and engage a corresponding surface inside the lid 4 when the lid 4 is arranged in the aforementioned closed position. The collar 14 preferably embraces the inner wrap 13.

As illustrated in FIGS. 2, 6 and 11, the collar 14 comprises a front wall 15, which is arranged in contact with the front wall 7 of the container 2, and two side walls 16, which are arranged on opposite sides of the front wall 15 and are arranged in contact with the side walls 8 of the container 2. Each side wall 16 of the collar 14 comprises a rear flap 18, which is squarely folded (i.e., by 90°) with respect to the side wall 16 and is arranged facing (preferably in contact) the rear wall 7 of the container 2.

With further reference to FIGS. 2, 6, 11, the collar 14 comprises a groove 17 obtained at the front wall 15 (in particular, this groove 17 extends starting from the upper edge of the front wall 15) so as to allow the cigarettes to be removed in a smoother way. Said groove 17 is preferably U-shaped. Furthermore, in said embodiment the front wall 15 of the collar comprises a flap 15*a* which projects from the lower edge of the front wall 15 and which has the same shape as the groove 17: said conformation of the collar 14 allows to obtain the collars 14 starting from a strip of material (for example wound in a reel) without waste of material (in other words, without scrap).

According to an embodiment not illustrated, the collar 14 can also comprise a bottom wall which is arranged in contact with the bottom wall 5 of the container (in other words, it is arranged between the bottom wall 5 of the container 2 and the inner wrap 13).

Furthermore, the pack 1 comprises a slider 19 which is firmly connected to the lid 4 and is slidingly coupled with the container 2 to slide relative to the container 2 along a sliding direction D1.

The slider 19 comprises a front wall 42 which is arranged facing (and at least partially rests against) the front wall 6 of the container 2 and is free to slide with respect to the front wall 6 of the container 2 along the sliding direction D1.

Preferably, the flap 15*a* of the front wall 15 of the collar 14 is arranged between the front wall 42 of the slider 19 and the front wall 6 of the container 2.

Therefore, the front wall 42 of the slider 19 slides freely relative to the container 2, relative to the inner wrap 13 and relative to the collar 14.

The slider 19 comprises, furthermore, a pair of side walls 23 which extend from the front wall 42, in particular from opposite sides of the front wall 42, and are squarely folded (i.e., by 90°) relative to the front wall 42 and against the side walls 16 of the collar 14 (i.e., the side walls 16 of the collar 14 are arranged between the side walls 23 of the slider and the side walls 8 of the container 2).

Preferably, the slider 19 comprises a pair of tabs 23*a* which extend from the lower side of the side walls 23 of the slider 19, are connected to the side walls 23 of the slider 19 by means of hinge lines and are folded around said hinge lines to be each arranged in contact with the respective side wall 23. In other words, each tab 23*a* is rotated by 180° around its hinge line and is arranged in contact with (i.e., in abutment against) the side wall 23.

The function of the tabs 23*a* is to limit the upper sliding of the slider 19; in particular, the sliding of the slider 19 upwards is blocked when the tabs 23*a* arrive at the side walls 16 of the collar 14.

Furthermore, the slider 19 has a rear wall 20 which is arranged in contact with the rear wall 7 of the container 2 and a rear wall 21 (i.e., a connection panel) which is connected to the rear wall 20 by means of a hinge 22 and is arranged in contact with the rear wall 11 of the lid 4.

In particular, the rear wall 20 of the slider 19 rests only against the rear wall 7 of the container 2 and therefore can slide freely with respect to the rear wall 7 along a sliding direction Dl while the rear wall 21 of the slider 19 is glued (by means of permanent glue) to the rear wall 11 of the lid 4 and therefore is rigidly and firmly fixed to the rear wall 11. The hinge 22 which connects the two rear walls 20 and 21 of the slider 19 allows the lid 4 (glued to the rear wall 21 of the slider 19) to rotate between the closed position (illustrated in FIGS. 1 and 3) and the open position (illustrated in the FIGS. 2 and 5); in other words, the hinge 22 which connects the two rear walls 20 and 21 of the slider 19 forms the hinge of the lid 4 and allows the rotation of the lid 4. As previously stated, the rear wall 20 of the slider 19 is only resting against the rear wall 7 of the container 2 so as to be able to slide freely along the sliding direction Dl relative to the rear wall 7; preferably, the rear wall 20 of the slider 19 is arranged under the rear flaps 18 of the collar 14 (i.e., between the rear flaps 18 of the collar 14 and the inner wrap 13) and slides freely relative to the container 2, relative to the inner wrap 13 and relative to the collar 14.

Figure 7:
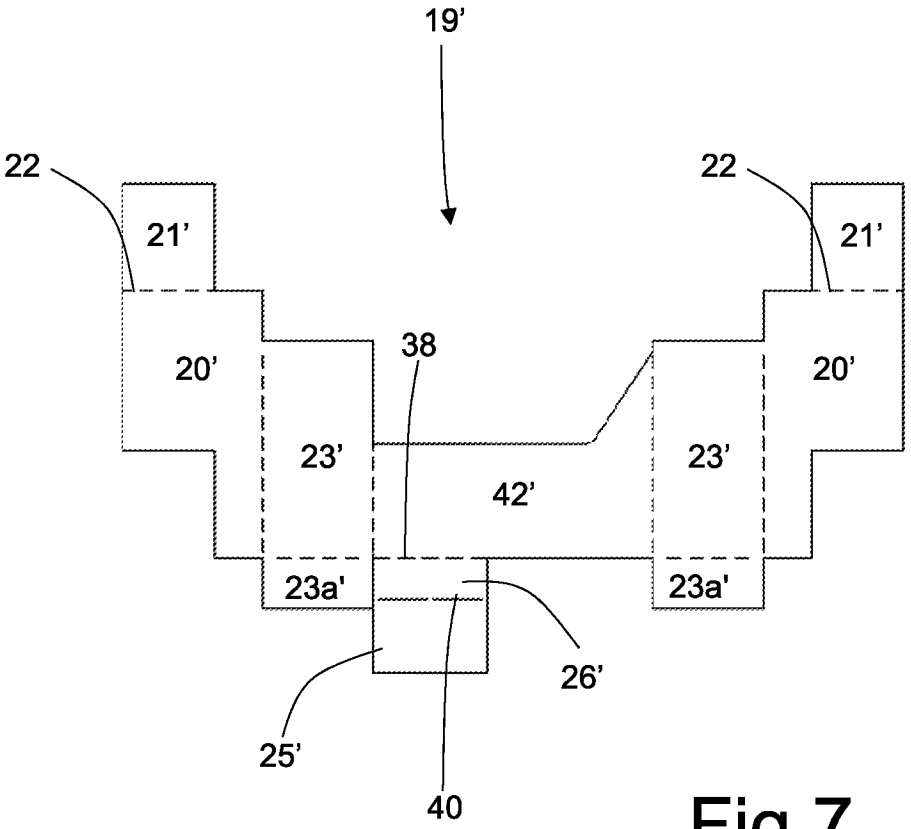
FIG. 7 is a plan view of a flat blank used to form the slider of the pack of cigarettes of FIG. 1.

With reference to FIG. 7, the slider 19 can be obtained starting from the blank 19' which provides: a front panel 42' intended to form the front wall 42 of the slider 19; two side panels 23', which are connected by hinge lines on opposite sides of the front panel 42' and are intended to form the side walls 23 of the slider 19; two rear panels 20', which are connected by means of hinge lines each to a side panel 23', on the opposite side relative to the front panel 42, and are intended to form the rear wall 20 of the slider 19, which is arranged in contact with the rear wall 7 of the container 2; two rear panels 21' each extending from the upper side of a rear panel 20', at a hinge line 22, and which are intended to form the rear wall 21 of the slider 19, which is arranged in contact (and fixed) to the rear wall 11 of the lid 4.

In detail, according to the illustrated embodiment, the rear wall 20 of the slider 19 is formed by the two panels 20' arranged side by side and coplanar. Similarly, the rear wall 21 of the slider 19 is also formed by the two panels 21' arranged side by side and coplanar.

It is understood that, according to embodiments not illustrated, the rear wall 20 of the slider 19 and/or the rear wall 21 of the slider 19 could also be made by means of a single panel.

FIGS. 3, 4 and 5 show the steps for opening the lid 4; in particular, in FIG. 3 the pack 1 of cigarettes is illustrated laterally with the lid 4 in the closed position, in FIG. 4 the pack 1 of cigarettes is illustrated laterally with the lid 4 in an intermediate position, and in FIG. 5 the 1 pack of cigarettes is illustrated laterally with the lid 4 in the open position. To pass from the closed position to the open position, the lid 4 is initially raised relative to the container 2 by means of a longitudinal translation movement (i.e. parallel to the longitudinal edges) which takes place along the sliding direction D1 (this lifting brings the lid 4 from the closed position to the open position); the lifting of the lid 4 relative to the container 2 occurs due to the sliding of the slider 19 upwards and ends when the tabs 23*a* of the slider 19 reach the side walls 16 of the collar 14. Once the translation of the lid 4 with respect to allow the container 2 ends (FIG. 4), the lid 4 is rotated relative to the container 2 around the hinge 22 until reaching the open position (FIG. 5).

As illustrated in FIGS. 9-13*b*, the pack 1 of cigarettes comprises, furthermore, a locking system 24 which is interposed between the container 2 and the slider 19 and, in the closed position of the lid 4, prevents (in a manner that can be deactivated by means of an external action by the user) the sliding of the slider 19 relative to the container 2. In other words, the locking system 24 keeps the slider 19 (hence the lid 4, which is glued to the slider 19) in the closed position of the lid 4 (illustrated in FIGS. 1, 3, 12*a* and 12*b*) by locking (preventing) the sliding of the slider 19 relative to the container 2; said locking of the sliding of the slider 19 relative to the container 2 provided by the locking system 24 can be deactivated by an external action of the user, so as to be deactivated when the user wishes to open the pack 1 of cigarettes (i.e. when sliding the slider 19, therefore the lid 4, relative to the container 2 is needed, in order to bring the lid 4 towards the open position).

In the embodiment illustrated in FIGS. 9-13*b*, the locking system 24 comprises a stop tab 25 (i.e. a contrast panel) which is integral with the front wall 6 of the container 2 and projects in a cantilever fashion from the front wall 6 of the container 2 towards the inside of the container 2; moreover, the locking system 24 comprises a stop tab 26 which is part of the slider 19, is folded by 180° against the front wall 42 of the slider 19, and has a free edge 27 which is designed to rest against a corresponding free edge 28 of the stop tab 25 in the absence of externally imposed deformations.

Preferably, the stop tab 25 is arranged laterally in the front wall 6, in a position proximal to the bottom wall 5 of the container 2.

Furthermore, the stop tab 26 can be glued to the front wall 42 of the slider 19.

In the closed position of the lid 4 (illustrated in FIGS. 1, 3, 12*a* and 12*b*) and in the absence of deformations imposed from the outside, the free edge 27 of the stop tab 26 (which is part of an integral with, possibly by gluing, the slider 19) is facing and aligned with (substantially resting against) the free edge 28 of the stop tab 25 (which projects from the front wall 6 of the container 2 and is integral with the front wall 6); in this situation, if a user tries to translate the lid 4 with respect to the rest of the container 2, he will not succeed as the translation movement of the lid 4 (firmly connected to the slider 19) is blocked by the contact between the stop tab 26 (which is integral with the slider 19) and the stop tab 25 (which is integral with the front wall 6 of the container 2), i.e. the interference between the two stop tabs 25 and 26 prevents the slider 19 from translating (hence the lid 4) relative to the container 2.

Figure 13A:
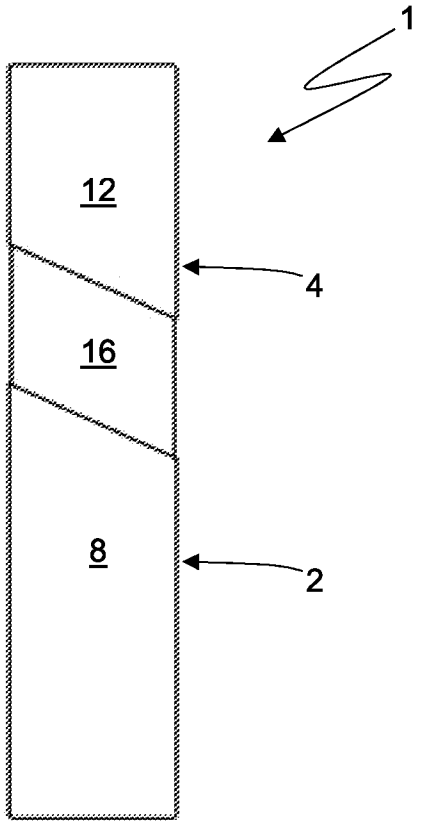
Figure 13B:
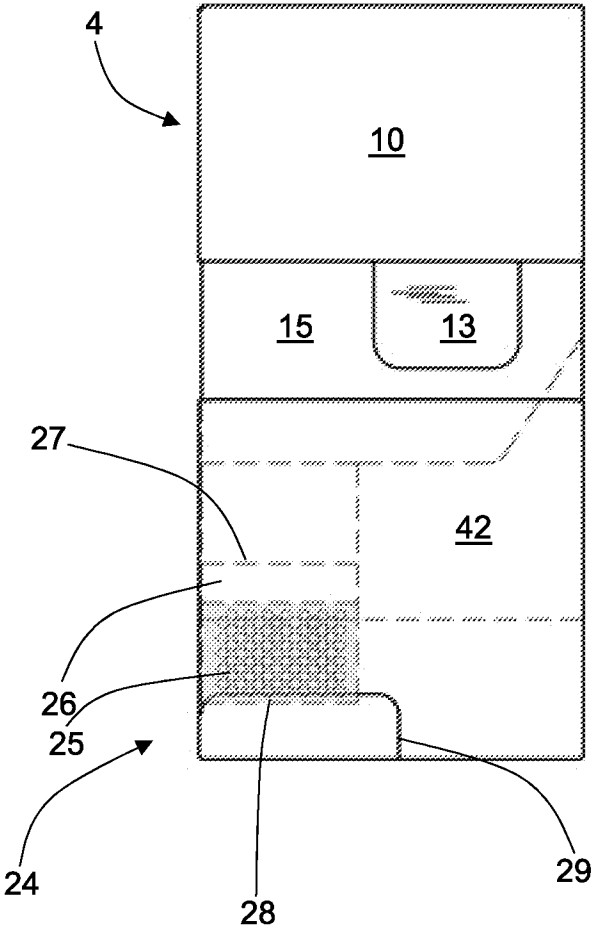

As illustrated in FIG. 13*b*, by applying an elastic deformation to the pack 1 of cigarettes from the outside, it is possible to misalign the free edge 27 of the stop tab 26 relative to the free edge 28 of the stop tab 25 and in this situation the slider 19 (hence the lid 4) can translate relative to the container 2 since during translation the free edge 27 of the stop tab 26 no longer comes into contact with the free edge 28 of the stop tab 25. This elastic deformation of the pack 1 of cigarettes can be obtained by pressing on the front wall 6 of the container 2 at the stop tab 26 so as to push the stop tab 26 inwards (as illustrated in FIG. 13*b*).

Figure 12A:
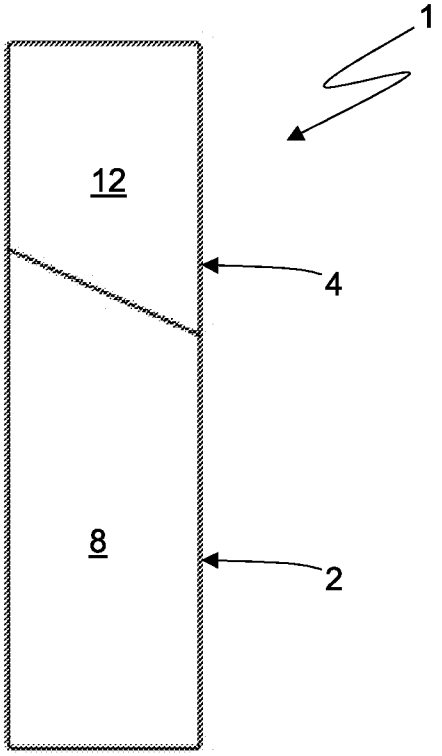
FIGS. 12*a* and 13*a* are side views of the pack of FIG. 1 in a closed position and in an intermediate position, respectively.
Figure 12B:
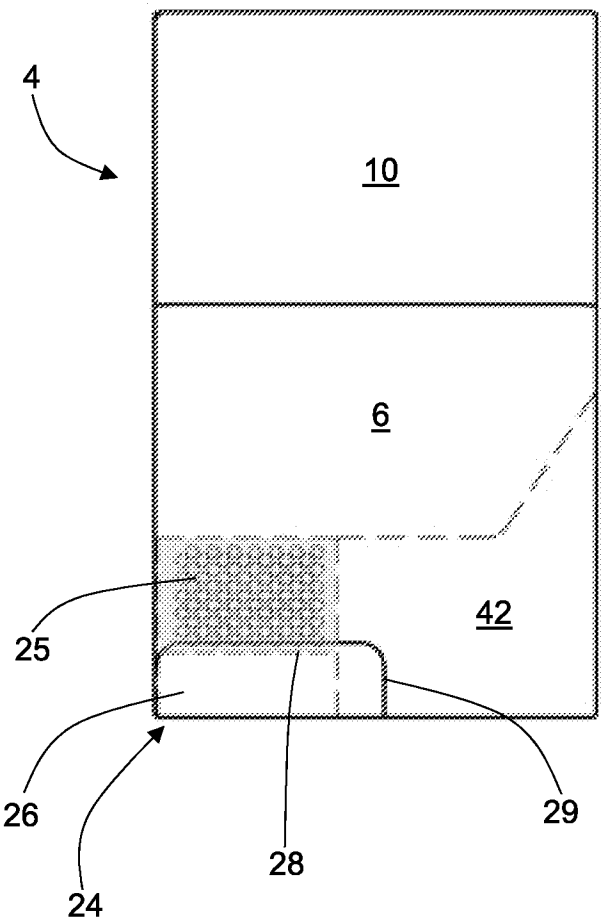
FIGS. 12*b* and 13*b* are front views respectively of the packs of FIGS. 12*a* and 13*a* in which the locking system has been highlighted.

By pressing on the front wall 6 of the container 2 at the stop tab 26, part of the front wall 6 of the container 2 is deformed, which pushes on the stop tab 26 so as so as to push the stop tab 26 inwards and therefore move the stop tab 26 farther away from the stop tab 25 (as illustrated in FIG. 13*b*). According to what is illustrated in FIGS. 1, 12*b* and 13*b*, to increase the deformation capacity of the front wall 6 of the container 2 towards the inside, the front wall 6 has a through cut 29 which delimits and defines a button 30 (the cut 29 which delimits and defines the button 30 has an "L" shape having two straight sides joined together by a small curve; alternatively, the cut 29 could have a "U" shape); in other words, the part of the front wall 6 of the container 2 enclosed in the cut 29 forms the button 30 which can be pushed inwards (detaching from the rest of the front wall 6 of the container 2 as illustrated in FIG. 13*b*) so as to push in turn the stop tab 26. According to a possible embodiment, the button 30 may have a particular graphic design that highlights the same with respect to the rest of the front wall 6 of the container 2 and possibly invites the user to press the button 30. According to a different embodiment not illustrated, the front wall 6 of the container 2 is devoid of the cut 29 and therefore of the button 30.

As illustrated in FIG. 13*b*, when the lid 4 is in the open position, the stop tab 25 and the stop tab 26 are partially overlapping one another (in other words, a part of the tab 26 is arranged facing and in contact with a part of the stop tab 25). Advantageously, said conformation ensures that the lid 4 can be easily returned to the closed position. In fact, in the event that when opening the lid, the tab 26 "bypasses" the stop tab 25, closing the lid would become difficult since the free edge 29 of the stop tab 26 would press against the upper edge of the stop tab 25.

Figure 8:
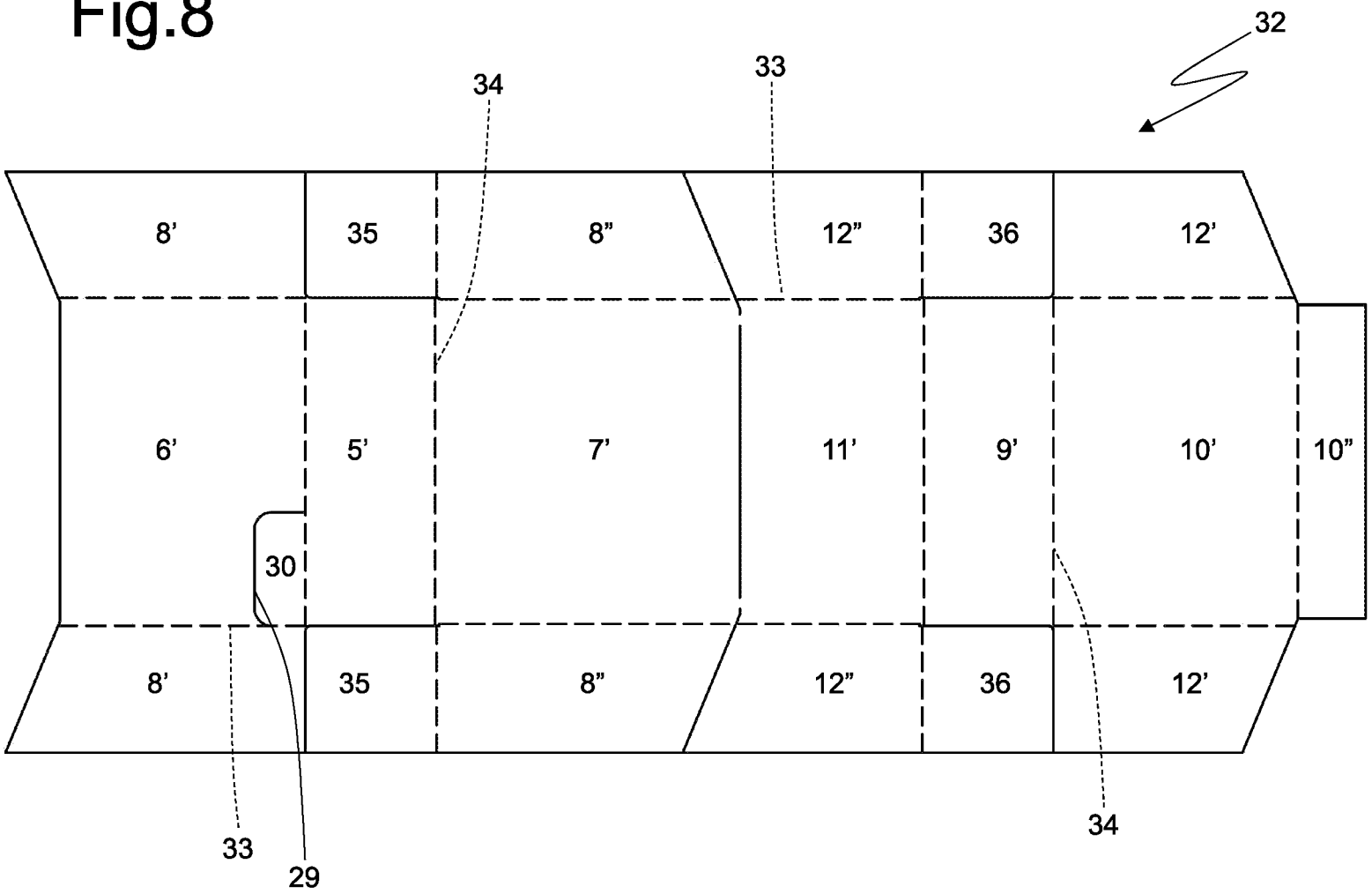
FIG. 8 is a plan view of a flat blank used to form a container provided with a lid for the pack of cigarettes of FIG. 1.
Figure 9:
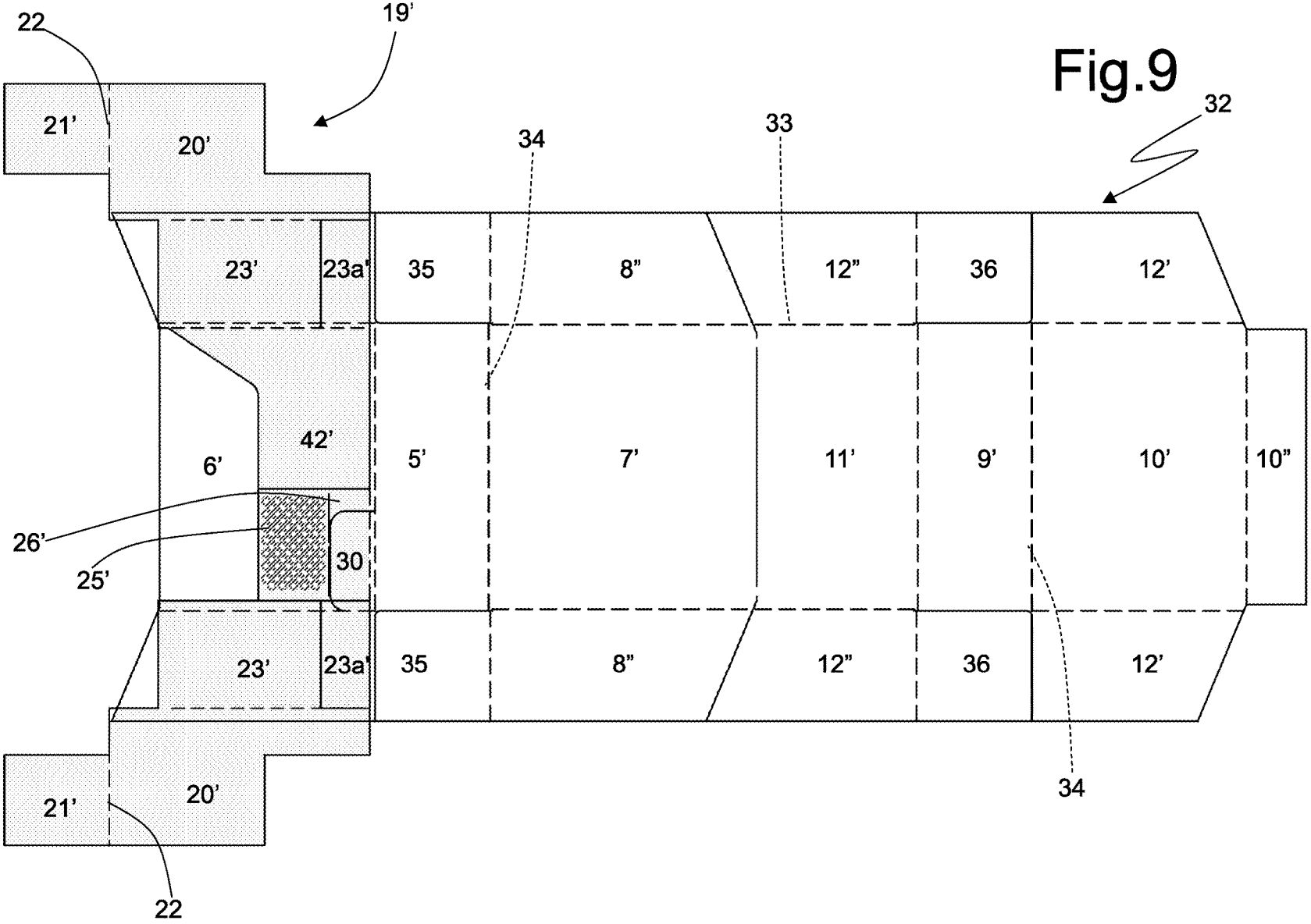
FIG. 9 is a plan view of the blanks of FIGS. 7 and 8 overlapping one another in order to better highlight the operation of the locking system.

As illustrated in FIG. 8, the container 2 (and the lid 4, which is part of the container 2) is obtained by folding a flat blank 32 having a substantially elongated rectangular shape around the inner wrap 3; in the following description, the parts of the blank 32 will be denoted where possible, with accented reference numbers equal to the reference numbers that denote the corresponding parts of the container 2.

The blank 32 has two longitudinal folding lines 33 (pre-weakened) and a plurality of transversal folding lines 34 (pre-weakened), which define, between the two longitudinal folding lines 33, a panel 6' forming the wall 6 front of the container 2, a panel 5' forming the bottom wall 5 of the container 2, a panel 7' forming the rear wall 7 of the container 2, a panel 11' forming the rear wall 11 of the lid 4, a panel 9' forming the top wall 9 of the lid 4, a panel 10' forming the front wall 10 of the lid 4, and a reinforcing flap 10" which is folded by 180° towards the inside of the container 2 and glued against the panel 10'.

Each panel 6' or 7' has two lateral tabs 8' or 8", which are arranged on opposite sides of the respective panel 6' or 7', are divided from the respective panel 6' or 7' by the longitudinal folding lines 33, and are overlapping and glued to one another so as to form the side walls 8 of the container 2. Each flap 8" of the panel 7' has a tab 35 which is folded by 90° with respect to the flap 8" and rests against the panel 5'.

Each panel 10' or 11' has two lateral flaps 12' or 12", which are arranged on opposite sides of the respective panel 10' or 11', are divided from the respective panel 10' or 11' by the longitudinal folding lines 33, and are overlapping and glued to one another to form the side walls 12 of the lid 4. Each flap 12" of the panel 11' has a tab 36 which is folded by 90° with respect to the flap 12" and rests against the panel 9'.

It is important to underline that in the blank 32 the panel 11' (i.e., the rear wall 11 of the lid 4) is permanently and firmly connected to the panel 7' (i.e., the rear wall 7 of the container 2); consequently, during the production of the pack 1 of cigarettes it is necessary to make an incision or a clean cut on the blank 32 along a separation line in order to separate the rear wall 11 of the lid 4 from the rear wall 7 of the container 2. In other words, the blank 32 is cut along the separation line so as to completely separate the rear wall 11 of the lid 4 from the rear wall 7 of the container 2.

FIG. 6 illustrates the blank 14' from which the collar 14 is obtained. The parts of the blank 14' are denoted, where possible, with accented reference numbers equal to the reference numbers which distinguish the corresponding parts of the collar 14. FIG. 6 illustrates the extended collar 14 in which all of its parts are highlighted, namely: the front wall 15, the two side walls 16, and the two rear flaps 18.

FIG. 7 illustrates the extended slider 19 in which all of its parts are highlighted, namely: the front wall 42, the two side walls 23, the two tabs 23', the rear wall 20, the rear wall 21 (connected to the rear wall 20 along the hinge 22), the locking tab 25 and the locking tab 26.

According to a preferred (but not binding) embodiment illustrated in FIG. 7, the stop tab 26 is connected to the front wall 42 of the slider 19 along a (pre-weakened) folding line 38, it is folded by 180° against the front wall 42, and can be glued to the front wall 42 by means of permanent glue (not illustrated).

Furthermore, according to a preferred (but not binding) embodiment illustrated in FIG. 7, the stop tab 25 is (only initially) connected to the stop tab 26 of the slider 19 along a tearable (pre-weakened) line 40, is glued to the front wall 6 of the container 2 by means of permanent glue 41 (schematically illustrated in FIGS. 12*b* and 13*b*), and is separated by tearing from the stop tab 26 (breaking the wrapping material along the tearable line 40) upon the first opening of the pack 1 of cigarettes (i.e. the first time the lid 4 is opened and then the button 30 is pressed for the first time). In other words, the stop tab 26 at one end is permanently connected to the front wall 42 of the slider 19 along the folding line 38 while at the opposite end it is (initially and temporarily) connected to the stop tab 25 along the tearable line 40 (which breaks upon the first opening of the pack 1 of cigarettes).

To produce the pack 1 of cigarettes described above, the packing machine described in the patent application EP1884467A1, in the Italian patent application BO2007A000039 or in the Italian patent application BO2007A000490 could be used. In these known packing machines, the slider 19 is coupled to the inner wrap 13 (and therefore folded around the inner wrap 13) before coupling the blank 32 to the inner wrap 13; according to alternative embodiments, the slider 19 can be coupled to the inner wrap 13 (and therefore folded around the inner wrap 13) before or after having coupled the collar 14 to the inner wrap 13. According to a possible alternative of known packing machines, the slider 19 is previously coupled and glued (by means of the permanent glue 41 between the stop tab 25 and the front wall 6 of the container 2) to the blank 32 and then the blank 32 together with the slider 19 (with which, at this point, forms a no longer divisible unit) is folded around the inner wrap 13 already provided with the collar 19.

According to a preferred embodiment, the fibres of the material (paper) that makes up the slider 19 must be oriented according to a direction D2 perpendicular to the sliding direction Dl (and therefore parallel to the folding line 38, parallel to the transverse edges of the container 2 and of the lid 4, and perpendicular to the longitudinal edges of the container 2 and of the lid 4). In fact, when the fibres of the material (paper) that makes up the slider 19 are parallel to the direction D2, the slider 19 flexes longitudinally less and therefore allows for a better functioning of the locking system 24 (i.e. it is more difficult that the locking system 24 does not work properly, as desired). In other words, when the fibres of the material (paper) that makes up the slider 19 are parallel to the direction D2, the slider 19 has a greater flexural stiffness in the longitudinal direction (i.e. along the sliding direction D1) and has a lower flexural stiffness in the longitudinal direction transversal direction (i.e. along the direction D2), therefore having the same stress the slider 19 deforms less longitudinally and deforms more transversely (to the advantage of the better functionality of the locking system 24).

In the embodiment illustrated in FIGS. 1, 2 and 8, the button 30 is arranged asymmetrical (i.e., off-centre) in the front wall 6 of the container 2, namely, the button 30 is arranged on one side of the front wall 6 of the container 2.

According to an alternative embodiment, however, the button 30 is arranged in the centre of the front wall 6 of the container 2 (i.e., it is centred between the two lateral edges of the front wall 6 of the container 2).

In the embodiments illustrated in the accompanying figures, the longitudinal and transverse edges are straight; alternatively, the longitudinal and/or transverse edges could be rounded or bevelled.

In the embodiments illustrated in the attached figures, the pack 1 of cigarettes contains a group of cigarettes; alternatively, the pack 1 of cigarettes may contain any other type of smoking articles such as for example cigars, electric or electronic cigarettes (i.e., cigarettes that generate an aerosol without combustion), cartridges and refills for electronic cigarettes, new generation cigarettes.

The embodiments described herein can be combined with each other without departing from the scope of the present invention.

The above-described pack 1 of cigarettes has numerous advantages.

Firstly, the pack 1 of cigarettes described above can be classified as "child-proof", that is, able to prevent children from opening the same. In fact, to open the pack 1 of cigarettes described above it is not enough to pull the lid 4 upwards (before rotating the lid 4) but it is necessary to exert, at the same time, a pressure on the button 30 (on the buttons 30); that is, to open the pack 1 of cigarettes described above it is necessary to carry out a particular sequence of movements which are not intuitive for a child.

Furthermore, the pack 1 of cigarettes described above, although classifiable as "child-proof", nevertheless has relatively simple and predictable opening methods for an adult.

The pack 1 of cigarettes described above requires a not excessive amount of wrapping material as a whole, since compared to a similar rigid pack of cigarettes with a standard hinged lid it has a slightly wider collar 14 and the presence of the slider 19, which it is relatively small; consequently, compared to a similar rigid pack of cigarettes with hinged lid of the standard type, the pack 1 of cigarettes described above has an overall increase in weight of wrapping material ranging from 10 to 20%.

Finally, the pack 1 of cigarettes described above can be made in a packing machine not too different from a standard packing machine for rigid packs of cigarettes with hinged lid; consequently, the preparation of a packing machine for the production of the pack 1 of cigarettes described above does not have particularly high costs.

The invention claimed is:

1. A pack (1) for smoking articles comprising:

a container (2), which is cup-shaped and has: an open top end (3), a bottom wall (5) opposite the open top end (3), a front wall (6) and a rear wall (7), which are parallel to and opposite one another, and two side walls (8), which are parallel to and opposite one another;

an inner wrap (14), which encloses a group of smoking articles and is housed in the container (2);

a hinged lid (4), which is cup-shaped, is movable between a closed position and an open position, and has: an open bottom end, a top wall (9), a front wall (10) and a rear wall (11), which are parallel to and opposite one another, and two side walls (12), which are parallel to and opposite one another;

a collar (14), which is glued on the inside of the container (2) so as to partially project out of the open top end (3) and engage a corresponding inner surface of the lid (4), when the lid (4) is arranged in a closed position;

a slider (19), which is firmly connected to the lid (4) and is coupled to the container (2) in a sliding manner so as to slide relative to the container (2) along a sliding direction (D1); and a locking system (24), which is interposed between the container (2) and the slider (19) and, in the closed position of the lid (4), prevents the slider (19) from sliding relative to the container (2);

wherein the hindering of the sliding of the slider (19) relative to the container (2), which is determined by the locking system (24), can be deactivated by means of an elastic deformation of at least part of the front wall (6) of the container (2);

wherein the locking system (24) comprises a first stop tab (25), which is integral with the front wall (6) of the container (2), projects from the front wall (6) of the container (2) towards the inside of the container (2), and has a first edge (28); and wherein the locking system (24) comprises a second stop tab (26), which is integral with the slider (19) and has a second edge (27), which, in the closed position, faces and is aligned with the first edge (28) of the first stop tab (25) in the absence of elastic deformations caused from the outside.

2. The pack (1) for smoking articles according to claim 1, wherein the first stop tab (25) is glued to the front wall (6) of the container (2) by a first permanent glue (41).

3. The pack (1) for smoking articles according to claim 1, wherein the first stop tab (25), only at first, is connected to the second stop tab (26) along a tearable line (40) and is designed to be separated, by tearing, from the second stop tab (26) upon the first opening of the pack (1) of cigarettes.

4. The pack (1) for smoking articles according to claim 1, wherein the first stop tab (25) is arranged in the front wall (6) in a position proximal to the bottom wall (5) of the container (2).

5. The pack (1) for smoking articles according to claim 1, wherein the first stop tab (25) and the second stop tab (26) are partially overlapping one another when the lid (4) is in the open position.

6. The pack (1) for smoking articles according to claim 1, comprising a button (30) which is obtained in the front wall (6) of the container (2), is defined and delimited by a through cut (29) and by pressing the same, the elastic deformation of at least a part of the front wall (6) of the container (2) is obtained.

7. The pack (1) for smoking articles according to claim 6, wherein the button (30) is arranged at the second stop tab (26) when the lid (4) is in the closed position.

8. The pack (1) for smoking articles according to claim 1, wherein the container (2) is designed to be elastically deformed in order to deactivate the hindering of the sliding of the slider (19) relative to the container (2), which is determined by the locking system (24), by pressing on the front wall (6) of the container (2) in the area of the second stop tab (26) so as to push the second stop tab (26) inwards.

9. The pack (1) for smoking articles according to claim 1, wherein fibers of the material making up the slider (19) are oriented according to a direction (D2), which is perpendicular to the sliding direction (D1).

10. The pack (1) for smoking articles according to claim 1, wherein the slider comprises a first rear wall (20), which is arranged facing the rear wall (7) of the container (2) so as to slide relative to the rear wall (7) of the container (2), and a second rear wall (21), which is connected to the first rear wall (20) by a hinge (22) and is glued to the rear wall (11) of the lid (4).

11. The pack (1) for smoking articles according to claim 10, wherein:

the collar (14) comprises a front wall (15) and two side walls (16);

each side wall (16) of the collar (14) comprises a rear flap (18), which is perpendicular to the side wall (16) and is arranged between the first rear wall (20) of the slider (19) and the rear wall (7) of the container (2); and the first rear wall (20) of the slider (19) has a pair of tabs (23), which are perpendicular to the first rear wall (20) and rest against the side walls (16) of the collar (14).

* * * * *